US010094252B2

(12) United States Patent
Brenner

(10) Patent No.: US 10,094,252 B2
(45) Date of Patent: Oct. 9, 2018

(54) CAMSHAFT ADJUSTER

(71) Applicant: Schaeffler Technologies AG & Co. KG, Herzogenaurach (DE)

(72) Inventor: Holger Brenner, Obermichelbach (DE)

(73) Assignee: Schaeffler Technologies AG & Co. KG, Herzogenaurach (DE)

( * ) Notice: Subject to any disclaimer, the term of this patent is extended or adjusted under 35 U.S.C. 154(b) by 135 days.

(21) Appl. No.: 15/313,896

(22) PCT Filed: Apr. 7, 2015

(86) PCT No.: PCT/DE2015/200249
§ 371 (c)(1),
(2) Date: Nov. 23, 2016

(87) PCT Pub. No.: WO2015/180716
PCT Pub. Date: Dec. 3, 2015

(65) Prior Publication Data

US 2017/0159509 A1 Jun. 8, 2017

(30) Foreign Application Priority Data

May 27, 2014 (DE) ..... 10 2014 210 073

(51) Int. Cl.
*F01L 1/46* (2006.01)
*F01L 1/344* (2006.01)

(52) U.S. Cl.
CPC ..... *F01L 1/3442* (2013.01); *F01L 1/46* (2013.01); *F01L 2001/34453* (2013.01); *F01L 2001/34456* (2013.01); *F01L 2001/34483* (2013.01)

(58) Field of Classification Search
CPC ..... F01L 2001/3445; F01L 2001/34453; F01L 2001/34483; F01L 1/46
(Continued)

(56) References Cited

U.S. PATENT DOCUMENTS 7,597,073 B2 10/2009 Asahi
8,051,818 B2 11/2011 Meyer
(Continued)

FOREIGN PATENT DOCUMENTS

DE 102007038400 3/2008
DE 102009041755 4/2010
(Continued)

*Primary Examiner* — Jorge Leon, Jr.
(74) *Attorney, Agent, or Firm* — Davidson, Davidson & Kappel, LLC

(57) ABSTRACT

A camshaft adjuster including a drive element, a first output element and a second output element all having a plurality of vanes; the two output elements can be braced relative to one another in the peripheral direction using an expanding spring located between the output elements; only the first output element is designed in such a way as to be connectable to a camshaft; a locking mechanism can lock the two output elements together and unlock same such that the two output elements are jointly or separately rotatable relative to the drive element; a vane of the second output element is in contact with a vane of the drive element, and the expanding spring puts a vane of the first output element at a distance from the vane of the drive element, so the first output element is in an angular position relative to the drive element which lies within the angle adjustment range between the first output element and the drive element.

10 Claims, 3 Drawing Sheets

(Section F-F)

(58) Field of Classification Search
USPC ..... 123/90.15, 90.17
See application file for complete search history.

(56) References Cited

U.S. PATENT DOCUMENTS

| | | | | |
|---|---|---|---|---|
| 9,032,924 | B2 | 5/2015 | Busse | |
| 9,103,240 | B2 | 8/2015 | Heinemann | |
| 2005/0226736 | A1 | 10/2005 | Lancefield et al. | |
| 2009/0183702 | A1* | 7/2009 | Knecht | F01L 1/022 123/90.15 |
| 2012/0279464 | A1* | 11/2012 | Tateno | F01L 1/3442 123/90.15 |
| 2013/0284132 | A1* | 10/2013 | Watanabe | F01L 1/34 123/90.15 |
| 2014/0102392 | A1* | 4/2014 | Busse | F01L 1/3442 123/90.17 |
| 2015/0019105 | A1* | 1/2015 | Vukovich | F02D 13/0219 701/101 |

FOREIGN PATENT DOCUMENTS

| | | | |
|---|---|---|---|
| DE | 10 2011 007 883 | A1 | 10/2012 |
| DE | 102011079183 | | 1/2013 |

* cited by examiner (Section F-F)

CAMSHAFT ADJUSTER

The present invention relates to a camshaft adjuster.

BACKGROUND

Camshaft adjusters are used in internal combustion engines for varying the timing of the combustion chamber valves in order to be able to variably configure the phase relation between a crankshaft and a camshaft in a defined angular range between a maximum advanced position and a maximum retarded position. Adapting the timing to the instantaneous load and speed decreases the fuel consumption and reduces the emissions. For this purpose, camshaft adjusters are integrated into a drive train, via which a torque is transmitted from the crankshaft to the camshaft. This drive train may be designed as a belt drive, chain drive, or gearwheel drive, for example.

In a hydraulic camshaft adjuster, the output element and the drive element form one or multiple pairs of oppositely acting pressure chambers which may be acted on by hydraulic medium. The drive element and the output element are situated coaxially. The filling and emptying of individual pressure chambers generates a relative movement between the drive element and the output element. The spring acting rotatively between the drive element and the output element pushes the drive element with respect to the output element in a preferred direction. This preferred direction may be the same as or opposite to the rotation direction.

The vane cell adjuster is one design of the hydraulic camshaft adjuster. The vane cell adjuster includes a stator, a rotor, and a drive wheel having external teeth. The rotor is designed as an output element, usually having a design that is connectable to the camshaft in a rotatably fixed manner. The drive element contains the stator and the drive wheel. The stator and the drive wheel are connected to one another in a rotatably fixed manner, or alternatively are designed as one part. The rotor is situated coaxially with respect to the stator, and within the stator. With their radially extending vanes, the rotor and the stator form oppositely acting oil chambers which may be acted on by oil pressure and which allow a relative rotation between the stator and the rotor. The vanes are designed either as one part with the rotor or the stator, or as an "inserted vane" in grooves in the rotor or the stator which are provided for this purpose. In addition, the vane cell adjusters have various sealing covers. The stator and the sealing covers are secured to one another via multiple screw connections.

Another design of the hydraulic camshaft adjuster is the axial piston adjuster. A displacement element is axially displaced via oil pressure, and via helical teeth generates a relative rotation between a drive element and an output element.

Another design of a camshaft adjuster is the electromechanical camshaft adjuster, which includes a three-shaft gear (a planetary gear, for example). One of the shafts forms the drive element, and a second shaft forms the output element. Rotational energy may be supplied to the system or discharged from the system via the third shaft with the aid of an actuating device, for example an electric motor or a brake. A spring which assists with or returns the relative rotation between the drive element and the output element may be additionally provided.

DE 10 2011 007 883 A1 describes a camshaft adjuster which includes two output elements and one drive element, which include vanes which in the axial direction overlap with the lateral surfaces of the particular adjacent element.

SUMMARY OF THE INVENTION

An object of the present invention is to provide a camshaft adjuster which has particularly reliable central positioning between the output element, which is connected to the camshaft, and the drive element of a camshaft adjuster.

The approach according to the present invention thus includes a hydraulic camshaft adjuster with a drive element, a first output element, and a second output element, the drive element and the two output elements each including multiple vanes, the two output elements being braceable in the circumferential direction with the aid of an expanding spring situated between the output elements, and only the first output element being designed to be connectable to a camshaft, and it being possible for a locking mechanism to lock or unlock the two output elements with respect to one another so that the two output elements are either jointly or separately rotatable relative to the drive element, a vane of the second output element contacting a vane of the drive element, and the expanding spring spacing a vane of the first output element apart from the vane of the drive element so that the first output element is in an angular position relative to the drive element which is within the angular adjustment range between the first output element and the drive element.

As a result, an intermediate position, in particular a center position between the output element, which is connectable or connected to the camshaft, and the drive element is achievable independently of the oil supply. The intermediate position is to be found within the adjustment range between the output element which is connectable or connected to the camshaft, and the drive element, provided that the intermediate position does not correspond to the angular positions in the end stops. The center position is that angular position within the adjustment range for which virtually the same path to the particular end stops would have to be covered in the circumferential direction.

Thus, the vane of the second output element, which is not connectable or connected to the camshaft, is in contact with the vane of the drive element. This contact may be secured by a securing mechanism. The vanes of the drive element, the first output element, and the second output element for forming working chambers which may be acted on hydraulically are well known from the prior art. The extent of the meaning of what constitutes the vane of the second output element, which is contacted by the vane of the drive element, is not limited solely to the design of a working chamber which may be acted on hydraulically, but, rather, also includes, for example, a flap, piston, or the like which is acted on by the expanding spring and which is supported on the vane of the drive element. In this regard, it is important that due to the expanding spring, the first output element is then pushed or pulled into the angle adjustment range.

In one embodiment of the present invention, in the locked state a vane of the first output element at least partially overlaps a vane of the second output element, and together with a vane of the drive element form a shared working chamber which may be acted on by pressure for displacing both output elements relative to the drive element. The at least partial overlap of the two vanes is understood as being viewed along the rotational axis of the camshaft adjuster.

In one advantageous embodiment, the working chamber is delimited in the circumferential direction by the vane of the drive element and a vane of the first output element, and is delimited in the axial direction by the vane of the second output element and a cover element which is connected in a rotatably fixed manner to the drive element. These delimitations are sealed off at least in such a way that a pressure may build up in the working chamber due to supplying the oil from the oil pump.

In one embodiment of the present invention, in the locked state of both output elements with respect to one another, the two output elements are rotatable together relative to the drive element with the aid of hydraulic medium pressure. In the contacting position of the second output element with the drive element, this working chamber has a volume that is smaller than the volume of the working chamber in the noncontacting position of the second output element with the drive element. As a result, variable pressure boosting is advantageously present in which in the contact position, the camshaft adjuster is activatable with the oil pressure and a small oil volume, since the oil pressure acts only on the surface area of the vane of the first output element. If the first output element is now moved, the second output element is also moved due to the engaged locking mechanism, and the contact of the vane of the second output element with the vane of the drive element is released. The oil pressure may now also act on the vane of the second output element. Upon continued adjustment, the oil pressure thus acts on a larger pressure surface, which is formed by the vanes of the two output elements situated in succession in the axial direction.

The locking mechanism, which may allow or prevent the relative rotation between the first and the second output element, is designed in such a way that a locking piston may engage with a locking slot and prevent a relative rotation between the two output elements.

In one preferred design, the locking mechanism includes a locking piston and a locking slot with a partially circumferential groove, and when the locking piston is engaged in the groove, the first output element is rotatable with respect to the second output element in the direction of the contact of the vanes of the drive element and the second output element. A locking slot which is designed as a groove has the advantage that the locking piston may engage very reliably with the locking slot. In addition, the groove delimits an angular range which extends from the center position to the stop position, at which the vane of the second output element contacts the vane of the drive element. In this regard, the two output elements are rotatable with respect to one another in the angular range from the center position to the stop position, and are braced by the expanding spring. If the two output elements are rotated with respect to one another against the force of the expanding spring, for example by the action of hydraulic pressure on a working chamber, and the pressure drops, the center position is reliably reached due to the relaxation of the expanding spring. In addition, the expanding spring compensates for the camshaft frictional torque which moves the first output element in the direction of the stop position. If the internal combustion engine is now suddenly switched off and the first output element is outside the above-mentioned angular range, the camshaft frictional torque moves the first output element into the locking position in which the locking piston engages with the locking slot designed as a groove. The expanding spring presses the locking piston against the end of the groove. For this purpose, the locking piston is accommodated by the first or the second output element, and the locking slot is situated in the corresponding other output element. However, the camshaft frictional torque is not sufficient to further pretension the expanding spring in the direction of the stop position. In this regard, the force from the camshaft frictional torque is higher than the elastic force only in one area of the spring characteristic curve.

In another embodiment of the present invention, the locking slot has a borehole situated within the partially circumferential groove, no rotation between the output elements being possible when the locking piston is engaged in the borehole. The influence of the camshaft alternating torques may advantageously be reduced by the borehole, in particular in the center position.

In one embodiment of the present invention, the locking slot is formed by the second output element, and the locking piston is accommodated by the first output element. In this way, the second output element may advantageously occupy minimal installation space in the axial direction, since the second output element has the function of support with the aid of the vane on the vane of the drive element and the locking slot. In contrast, in the installation space in the axial direction, the first output element is determined by the axial width of its vanes, which are acted on by hydraulic pressure. It is therefore advantageous for the locking piston to be accommodated in the first output element, which is connectable or connected to the camshaft.

In one advantageous embodiment of the camshaft adjuster, it includes a second spring which braces the first output element and/or the second output element with respect to the drive element. The second spring may advantageously brace the locked assembly of the two output elements with respect to the drive element in a preferred direction.

In one advantageous embodiment, the two output elements have a depression which accommodates an expanding spring which is designed as a coil spring. Here, the space-saving accommodation of the expanding spring is advantageous.

In another embodiment of the present invention, the first output element includes a hydraulic medium channel which communicates with the working chamber, which is delimited by the contact of the vane of the drive element with the vane of the second output element. The oil which is necessary for rotating the output element assembly may thus be reliably introduced into the working chamber.

Independence of the oil temperature with regard to the adjustment into a center position when the engine is abruptly shut off is achieved due to the provision according to the present invention of two output elements and a drive element in a camshaft adjuster.

BRIEF DESCRIPTION OF THE DRAWINGS

Exemplary embodiments of the present invention are illustrated in the figures.

DETAILED DESCRIPTION

Figure 1:
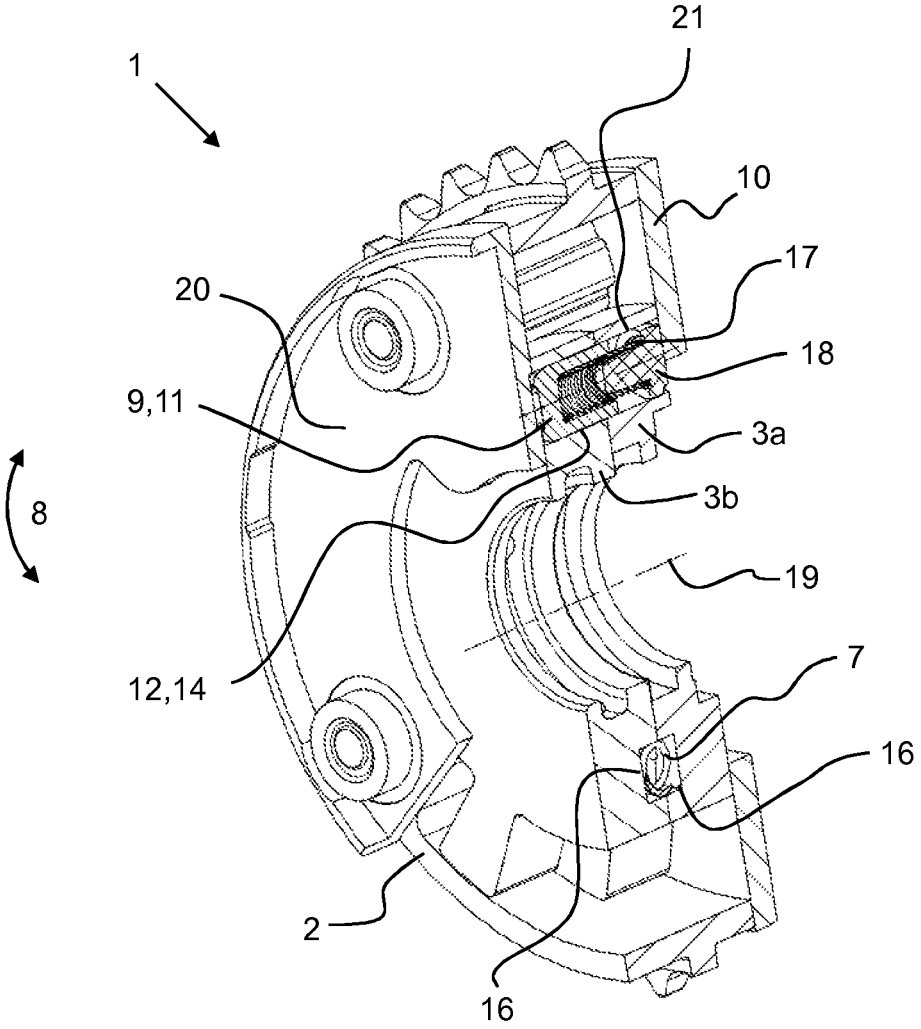
FIG. 1 shows a camshaft adjuster according to the present invention in a section along its rotational axis.

FIG. 1 shows a camshaft adjuster 1 according to the present invention in a section along its rotational axis 19.

The section follows section line F-F in the figures described below. Camshaft adjuster 1 includes a first output element 3*a*, a second output element 3*b*, and a drive element 2. The two output elements 3*a* and 3*b* rest flatly with their end faces against one another, and are situated in succession along rotational axis 19. First output element 3*a* is situated on the side of camshaft adjuster 1 facing the camshaft, and is connected or designed to be connectable to the camshaft, not illustrated here. Second output element 3*b* is situated on the side of camshaft adjuster 1 facing away from the camshaft. Both output elements 3*a* and 3*b* are initially interlocked with one another in the circumferential direction 8, as discussed below with reference to the further figures.

Camshaft adjuster 1 is axially delimited on the one hand by a cover element 10 which is situated on the side facing the camshaft and connected in a rotatably fixed manner to drive element 2, and which rests in a sealing manner against first output element 3*a*, and on the other hand by a sealing front cover 20 which is situated on the side of camshaft adjuster 1 facing away from the camshaft and likewise connected in a rotatably fixed manner to drive element 2. On their mutually facing end faces, output elements 3*a* and 3*b* each have a depression 16 in which an expanding spring 7 is accommodated. Expanding spring 7 presses the two output elements 3*a* and 3*b* apart in circumferential direction 8, so that vanes 5 and 6 of output elements 3*a* and 3*b*, respectively, overlap only partially in the axial direction, and the pressure surfaces of vanes 5 and 6, which are acted on by pressure from pressure oil in working chambers A, B, are spaced apart from one another in circumferential direction 8.

Output element 3*a* has a borehole 21 which is aligned with borehole 14 in locking slot 12, and which accommodates locking piston 11, a cartridge 18, and a locking spring 17 of locking mechanism 9. Locking spring 17, which is designed as a compression spring, presses locking piston 11 into locking slot 12, provided that no oil pressure is present at locking piston 11. Due to the overlap of locking piston 11 with borehole 21 and borehole 14, both output elements 3*a* and 3*b* are rotatably fixed with respect to one another. Locking spring 17 is supported on the one hand on a cartridge 18 situated in borehole 21 in first output element 3*a*, and on the other hand on locking piston 11. Locking piston 11 strikes against front cover 20 in the axial direction. Cartridge 18 strikes against cover element 10 in the axial direction. Locking slot 12 is formed by second output element 3*b*, and includes borehole 21 and a groove 13 which extends in the circumferential direction. Borehole 21 is situated within groove 13. Since locking piston 11 is not completely countersinkable in borehole 21, and therefore is not engaged with locking slot 12, uncontrolled twisting between the two output elements 3*a* and 3*b* is prevented, thus also ensuring that working chambers A and B maintain a pressure-tight design, and vanes 5 and 6 are not spread wide enough apart that a hydraulic short circuit may occur between working chambers A and B.

Figure 2:
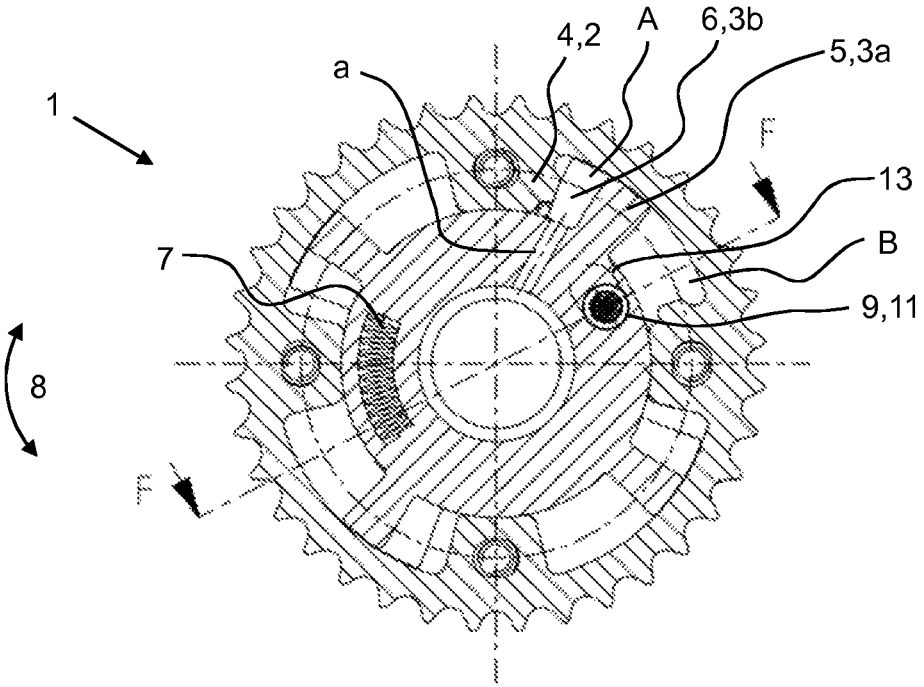
FIG. 2 shows a cross section of the camshaft adjuster according to FIG. 1 in a base position of the first output element.

FIG. 2 shows a cross section of camshaft adjuster 1 according to FIG. 1 in a base position of first output element 3*a*. The first quadrant is considered for explaining the mode of functioning of the mechanism. Clearly, vanes 4, 5, 6, working chambers A, B, and the pressure medium supply channels are repeated in the circumferential direction in the other quadrants.

Vane 6, designed as one part with second output element 3*b*, is in contact with vane 4, designed as one part, of drive element 2. Expanding spring 7 interlocks first output element 3*a* with second output element 3*b* in such a way that vane 5 of first output element 3*a* partially overlaps vane 6 and delimits a working chamber A in circumferential direction 8. Working chamber A is delimited in the axial direction by vane 6 of second output element 3*b* and front cover 20 on the side facing away from the camshaft, and by cover element 10 on the side facing the camshaft.

The contour of groove 13 in locking slot 12 which is formed in a stepped manner by groove 13 and borehole 14 is clearly apparent. Locking piston 11 is engaged with borehole 14. Due to the contact between vanes 4 and 6, engaged locking piston 11 prevents an adjustment that would result in a reduction in the size of working chamber A. An adjustment that would result in a reduction in the size of working chamber B may take place by supplying pressure medium (pressure oil) via hydraulic medium channel a. Working chamber A may be filled and pressurized, and both output elements 3*a* and 3*b* may move in the clockwise direction without locking piston 11 becoming disengaged from borehole 14. Hydraulic medium channel a may hereby advantageously introduce pressure oil virtually free of coverings of its opening into working chamber A.

Figure 3:
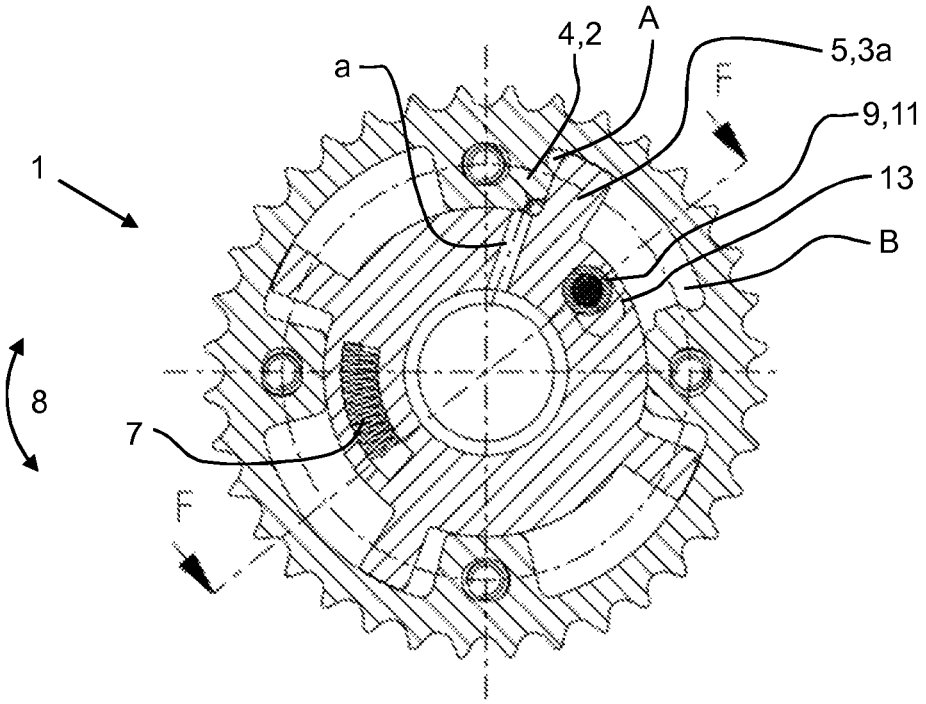
FIG. 3 shows a cross section of the camshaft adjuster according to FIG. 1 in a first end stop position of the first output element.

FIG. 3 shows a cross section of camshaft adjuster 1 according to FIG. 1 in a first end stop position of first output element 3*a*.

When pressure oil is supplied to locking piston 11, the locking piston moves out of borehole 14 until its front side is aligned with the base of groove 13. Working chamber A may now be reduced in size by pressurizing working chamber B and/or due to the camshaft frictional torque and vane 5 may be moved toward vane 4 until the two vanes contact one another and form the first end stop position. The first end stop position of first output element 3*a* may be formed by the contact of vanes 5 and 6 of the two output elements 3*a* and 3*b* together with vane 4 of drive element 2, or by groove 13.

Locking piston 11 moves within groove 13 during this adjustment process. Groove 13 may form the first end stop position, in which the adjustment range made possible by groove 13 is selected to be smaller than the possible adjustment range between vanes 4 and 6. In this case, locking piston 11 strikes against the end of groove 13 before vanes 4 and 6 contact one another.

The expanding spring is tensioned during this operation, so that first output element 3*a* may arrive back at the base position when the oil pressure in working chamber B falls away. In the process, locking piston 11 is guided in groove 13 and aligns the groove with borehole 14 and may engage in same, or strikes against the other end of groove 13.

Figure 4:
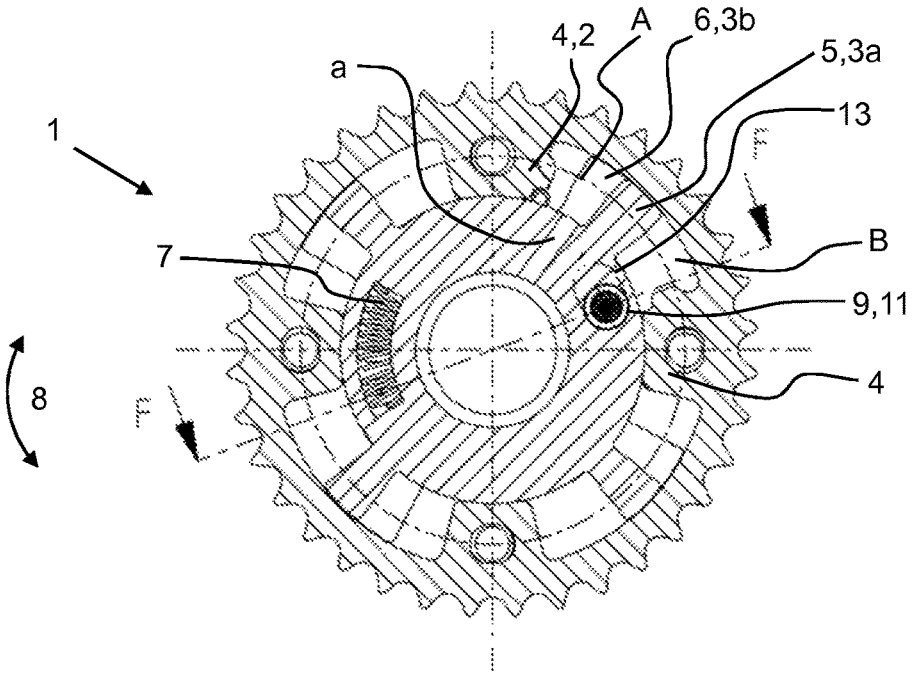
FIG. 4 shows a cross section of the camshaft adjuster according to FIG. 1 in the center position.

FIG. 4 shows a cross section of camshaft adjuster 1 according to FIG. 1 in the center position of first output element 3*a*.

In this angular position of first output element 3*a*, although the volumes of working chambers A and B are not equal, vane 5 of first output element 3*a* in each case has virtually the same spacing in each case from vanes 4 in circumferential direction 8. Accordingly, vane 5 would cover virtually the same path (angle) to the first or second end stop position in the clockwise direction or in the counterclockwise direction. In this state of camshaft adjuster 1, expanding spring 7 has the same pretension as in FIG. 2. Locking mechanism 9 likewise remains locked, as in the state in FIG. 2.

Figure 5:
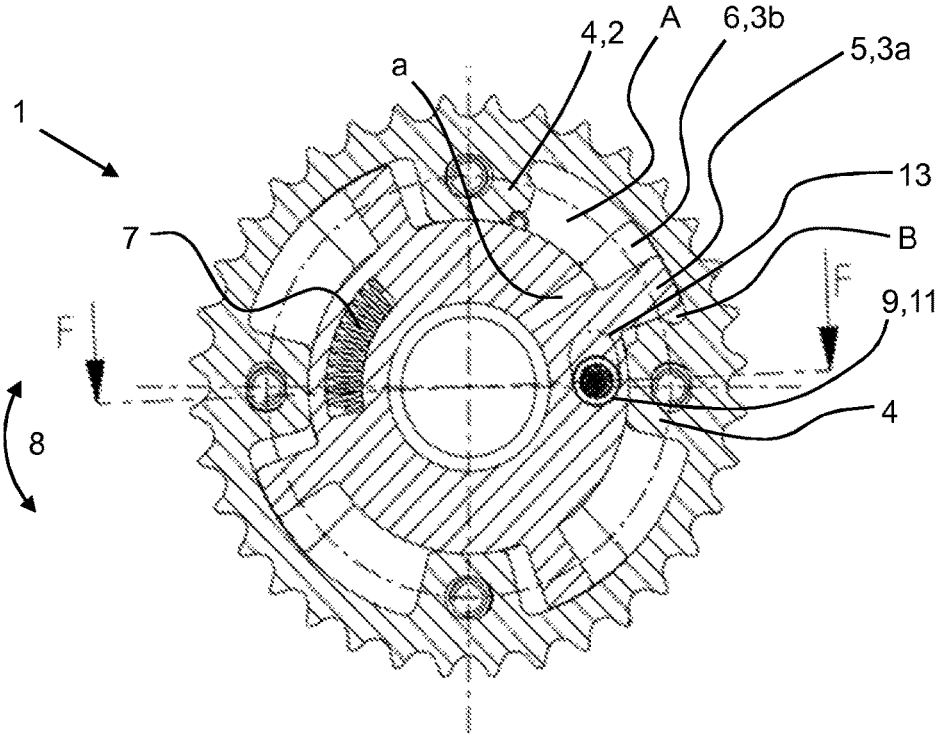
FIG. 5 shows a cross section of the camshaft adjuster according to FIG. 1 in a second end stop position of the first output element.

FIG. 5 shows a cross section of camshaft adjuster 1 according to FIG. 1 in a second end stop position of first output element 3*a*.

The configuration of camshaft adjuster 1 largely corresponds to that from FIGS. 2 and 4. However, vane 5 of first output element 3*a* now has contact with vane 4 of drive element 2, successively situated in the circumferential direction, from FIG. 3. Vane 6 of second output element 3*b* is now spaced apart from this vane 4 in FIG. 5 in circumferential direction 8. Thus, working chamber B is delimited by vanes 6 and 4 in circumferential direction 8, and in the axial direction on the side facing the camshaft is delimited by vane 5 and cover element 10, and on the side facing away from the camshaft is delimited by front cover 20, which has a sealing design. Due to the spacing of vane 6 from vane 4 and the resulting connected design of working chamber B, working chamber B may easily be filled with pressure oil. A hydraulic medium channel may hereby advantageously introduce a pressure oil virtually free of coverings of its opening into working chamber B.

LIST OF REFERENCE SYMBOLS

1 camshaft adjuster
2 drive element
3*a* first output element
3*b* second output element
4 vane
5 vane
6 vane
7 expanding spring
8 circumferential direction
9 locking mechanism
10 cover element
11 locking piston
12 locking slot
13 groove
14 borehole
15 —
16 depression
a hydraulic medium channel
A working chamber
B working chamber
17 locking spring
18 cartridge
19 rotational axis
20 front cover

The invention claimed is:

1. A hydraulic camshaft adjuster comprising:
a drive element;
a first output element; and
a second output element,
the drive element and the first and second output elements each including multiple vanes,
the first and second output elements bracing against one another in a circumferential direction via an expanding spring situated between the first and second output elements,
only the first output element being configured to connect to a camshaft, and
a locking mechanism for locking or unlocking the first and second output elements with respect to one another so that the first and second output elements rotate either jointly or separately relative to the drive element,
a vane of the second output element contacting a vane of the drive element, and the expanding spring spacing a vane of the first output element apart from the vane of the drive element and
the first output element thus being in an angular position relative to the drive element within an angular adjustment range between the first output element and the drive element.

2. The camshaft adjuster as recited in claim 1 wherein in a locked state, a vane of the first output element at least partially overlaps a vane of the second output element, and together with a vane of the drive element form a shared working chamber acted on by hydraulic medium pressure for displacing both the first and second output elements relative to the drive element.

3. The camshaft adjuster as recited in claim 2 the working chamber is delimited in the circumferential direction by the vanes of the drive element and of the first output element, and is delimited in an axial direction by the vane of the second output element and a cover element connected in a rotatably fixed manner to the drive element.

4. The camshaft adjuster as recited in claim 2 wherein in the locked state, the first and second output elements rotate together relative to the drive element via the hydraulic medium pressure.

5. The camshaft adjuster as recited in claim 2 wherein the first output element includes a hydraulic medium channel communicating with the working chamber delimited by a contact of the vane of the drive element with the vane of the second output element.

6. The camshaft adjuster as recited in claim 1 wherein the locking mechanism includes a locking piston and a locking slot with a partially circumferential groove, and when the locking piston is engaged in the groove the first output element rotates with respect to the second output element in a direction of a contact of the vanes of the drive element and the second output element.

7. The camshaft adjuster as recited in claim 6 wherein the locking slot has a borehole situated within the partially circumferential groove, no relative rotation between the first and second output elements being possible when the locking piston is engaged in the borehole.

8. The camshaft adjuster as recited in claim 6 wherein the locking slot is formed by the second output element, and the locking piston is accommodated by the first output element.

9. The camshaft adjuster as recited in claim 1 wherein the camshaft adjuster includes a second spring bracing the first output element or the second output element with respect to the drive element.

10. The camshaft adjuster as recited in claim 1 wherein the first and second output elements each have a depression which accommodates an expanding spring designed as a coil spring.

* * * * *